US011267031B2

(12) United States Patent
McCann

(10) Patent No.: US 11,267,031 B2
(45) Date of Patent: Mar. 8, 2022

(54) EXPENDABLE HOLLOW CARRIER FABRICATION SYSTEM AND METHOD

(71) Applicant: Baker Hughes, a GE Company, LLC, Houston, TX (US)

(72) Inventor: Jason McCann, Cypress, TX (US)

(73) Assignee: Baker Hughes, a GE Company, LLC, Houston ( * ) Notice: Subject to any disclaimer, the term of this patent is extended or adjusted under 35 U.S.C. 154(b) by 468 days.

(21) Appl. No.: 16/145,485

(22) Filed: Sep. 28, 2018

(65) Prior Publication Data

US 2020/0102814 A1 Apr. 2, 2020

(51) Int. Cl.

*B21D 22/20* (2006.01)
*E21B 43/116* (2006.01)
*B21B 19/12* (2006.01)

(52) U.S. Cl.

CPC ..... *B21D 22/20* (2013.01); *B21B 19/12* (2013.01); *E21B 43/116* (2013.01); *B21B 2261/04* (2013.01)

(58) Field of Classification Search

CPC ..... E21B 43/116; E21B 43/117; F42B 3/08; F42B 1/02–032; B21D 22/20; B21D 22/22; B21D 22/26; B21D 22/30; B21D 22/16; B21B 19/00; B21B 19/12

USPC ..... 89/1.15, 1, 151; 102/306–310

See application file for complete search history.

(56) References Cited

U.S. PATENT DOCUMENTS 2,145,231 A * 1/1939 Alzner ..... E21B 43/116 175/4.57
2,200,487 A * 5/1940 Calvert ..... E21B 43/116 175/4.58
2,299,210 A * 10/1942 Calvert ..... E21B 43/116 175/4.55
3,013,492 A * 12/1961 Sexton ..... F42B 3/02 102/317
3,650,212 A 3/1972 Bauer
2010/0276136 A1 11/2010 Evans
2013/0292174 A1* 11/2013 Harvey ..... E21B 43/117 175/4.5
2015/0096434 A1 4/2015 White
2017/0115102 A1* 4/2017 Knight ..... E21B 43/117
2017/0211363 A1* 7/2017 Bradley ..... F42B 3/08
2017/0328134 A1 11/2017 Sampson
2018/0016878 A1 1/2018 Harive

FOREIGN PATENT DOCUMENTS

WO 2015/179787 11/2015

OTHER PUBLICATIONS

International Search Report and Written Opinion dated May 22, 2020 in corresponding PCT Application No. PCT/US19/53134.

* cited by examiner

*Primary Examiner* — Gregory D Swiatocha
*Assistant Examiner* — Bobby Yeonjin Kim
(74) *Attorney, Agent, or Firm* — Hogan Lovells US LLP

(57) ABSTRACT

Embodiments of the present disclosure include a method for fabricating a perforating gun including forming an expendable hollow carrier (EHC) via a drawing process. The method also includes determining a wall thickness of the EHC is above a threshold. The method includes machining a coupling component to at least one end of the EHC. The method further includes installing perforating components within an interior of the EHC.

9 Claims, 6 Drawing Sheets

EXPENDABLE HOLLOW CARRIER FABRICATION SYSTEM AND METHOD

BACKGROUND

1. Field of Invention

This disclosure relates in general to oil and gas tools, and in particular, to systems and methods for conveying ballistics into a wellbore.

2. Description of the Prior Art

Perforating systems may be used for the purpose, among others, of making hydraulic communication passages, called perforations, in wellbores drilled through earth formations so that predetermined zones of the earth formations can be hydraulically connected to the wellbore. Perforations are utilized because wellbores are typically completed by coaxially inserting a pipe or casing into the wellbore. The casing is retained in the wellbore by pumping cement into the annular space between the wellbore and the casing. The cemented casing is provided in the wellbore for the specific purpose of hydraulically isolating from each other the various earth formations penetrated by the wellbore. Perforating systems may include ballistic charges that form passages through the cemented casing, thereby enabling flow into an annulus of the wellbore. In various embodiments, perforating systems may include a series of perforating guns coupled together. Due to the properties of the wellbore, the housings forming the perforating guns may have certain pressure containing requirements. As a result, various dimensions of the perforating guns, such as a wall thickness, may have thresholds. The thresholds may make machining and/or forming certain components challenging.

SUMMARY

Applicant recognized the problems noted above herein and conceived and developed embodiments of systems and methods, according to the present disclosure, for perforating gun conveyance.

In an embodiment, a method for fabricating a perforating gun includes forming an expendable hollow carrier (EHC) via a drawing process. The method also includes determining a wall thickness of the EHC is above a threshold. The method includes machining a coupling component to at least one end of the EHC. The method further includes installing perforating components within an interior of the EHC.

In another embodiment, a method of for fabricating a perforating string includes acquiring a first expendable hollow carrier (EHC) having a first end and a second end, the first end comprising a first coupling component on an inner diameter and the second end comprising a second coupling component on an outer diameter. The method also includes acquiring a second EHC having a third end and fourth end, the third end comprising a third coupling component on an inner diameter and the fourth end comprising a fourth coupling component on an outer diameter. The method further includes coupling the second end of the first EHC directly to the third end of the second EHC via the first coupling component and the third coupling component. The method also includes positioning the first EHC and the second EHC within a wellbore.

In an embodiment, a system for performing perforating operations includes a perforating string and a wellbore conveyance system. The perforating string includes a plurality of perforating guns. Each perforating gun of the plurality of perforating guns includes an expendable hollow carrier (EHC) having a first end and a second end, the first end having a first coupling component along an inner diameter and the second end having a second coupling component along an outer diameter. Each perforating gun further includes ballistic material arranged within an interior of the EHC. In various embodiments, the wellbore conveyance system is coupled to the perforating string, the wellbore conveyance system translating the perforating string into the wellbore.

BRIEF DESCRIPTION OF THE DRAWINGS

The present technology will be better understood on reading the following detailed description of non-limiting embodiments thereof, and on examining the accompanying drawings, in which.

DETAILED DESCRIPTION OF THE INVENTION

Figure 1:
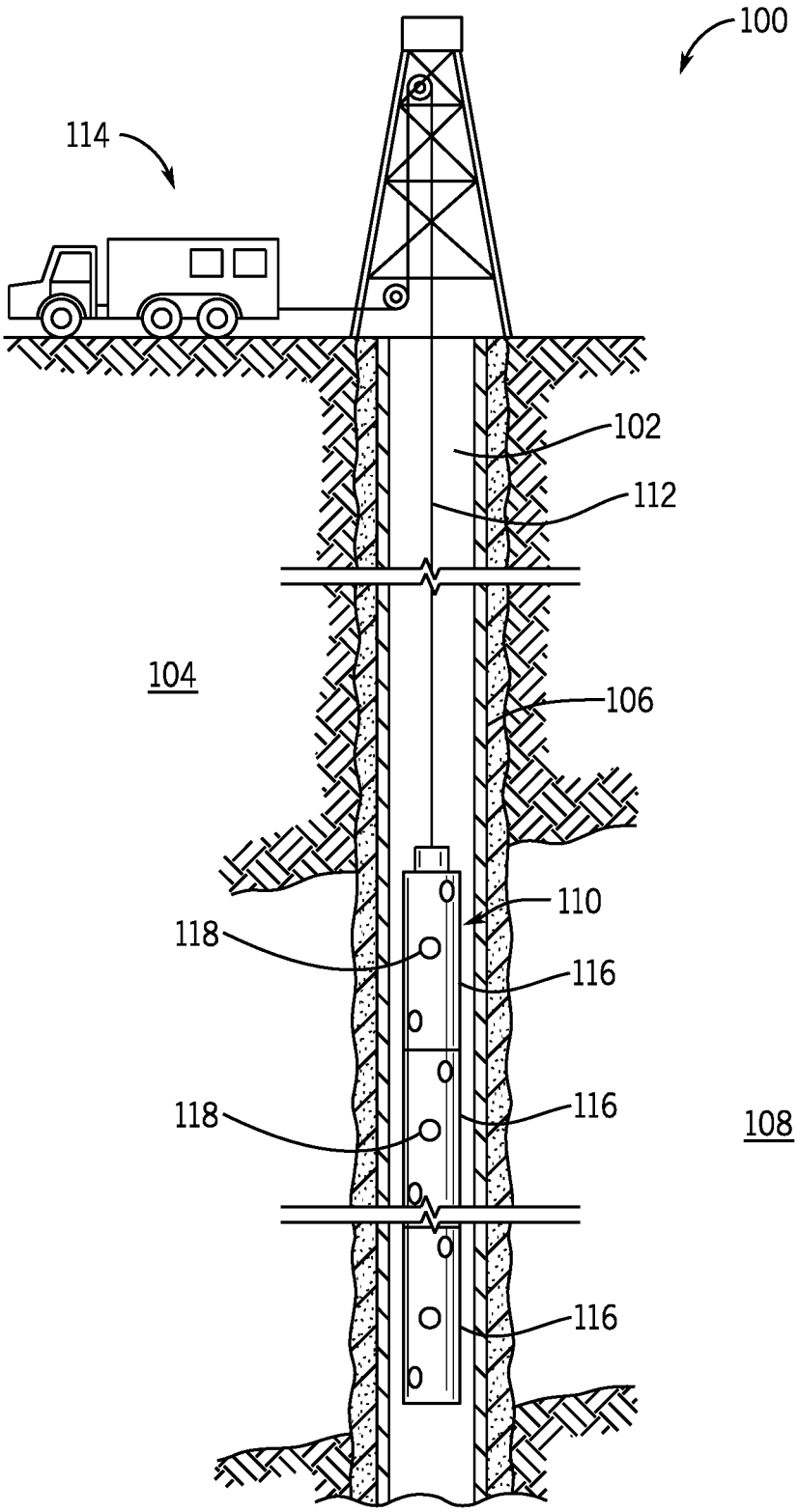
FIG. 1 is a schematic cross-sectional view of an embodiment of a perforating string within a wellbore, in accordance with embodiment of the present disclosure.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present invention are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

Embodiments of the present disclosure include an expendable hollow carrier (EHC) which may be used to form at least a portion of a perforating gun utilized in wellbore operations. In various embodiments, the EHC is an integrally formed component having a first open end and a second, closed end. In embodiments, the EHC is a generally cylindrical, integral piece of material. Moreover, the EHC may not include a seam, secondary connector, or the like along a length of the EHC between the first open end and the second closed end. In various embodiments, the second end includes a coupling component, such as threads, that may mate with a coupling component formed in a first end of a second EHC. As a result, a pair of EHCs may be directly coupled together via the coupling components, for example via threaded connections that form a box and pin arrangement. In various embodiments, the EHC is formed utilizing one or more manufacturing processes, such as a deep drawing process, flow forming process, or the like. In certain embodiments, the deep drawing process may form the EHC and thereafter a machining process may add the coupling components. However, in certain embodiments, a pair of manufacturing processes, such as both a deep drawing process and flow forming process, may be used to form the EHC prior to the machining of the coupling components. Accordingly, the EHCs may be utilized to directly couple perforating guns together to form a perforating string without utilizing intermediate coupling components, such as tandem subs. As a result, the perforating string may be lighter, shorter, and cheaper to use.

FIG. 1 is a schematic cross-sectional view of a well site 100 including a wellbore 102 extending into a downhole formation 104. The illustrated wellbore 102 includes a casing 106 extending along at least a portion of a length thereof, thereby forming a cased wellbore. In various embodiments, there may be cement positioned between the casing 106 and the formation 104, thereby securing the casing 106 in place. The illustrated formation 104 includes a recoverable or target section 108, which may include recoverable oil and gas products.

In the illustrated embodiment, a perforating system 110 is conveyed into the wellbore 102 using a wireline 112. While the perforating system 110 in the illustrated embodiment is conveyed via the wireline 112, it should be appreciated that tubing, slickline, and other deployment means, may be used as alternatives for the wireline 112. In the embodiment of FIG. 1, a surface truck 114 is provided at the surface for control and/or operation of the perforating system 110. The illustrated perforating system 110 includes a plurality of perforating guns 116. It should be appreciated that, in various embodiments, the perforating system 110 may include one, two, three, four, five, ten, twenty, or any other number of perforating guns 116. Moreover, the perforating system 110 may include other components, such as delays, intermediate subs, controllers, and the like, which have been omitted for clarity with the present discussion. In operation, shaped charges 118 provided in the perforating guns 116 may be detonated within the wellbore 102 to create perforations (not shown).

Figure 2:
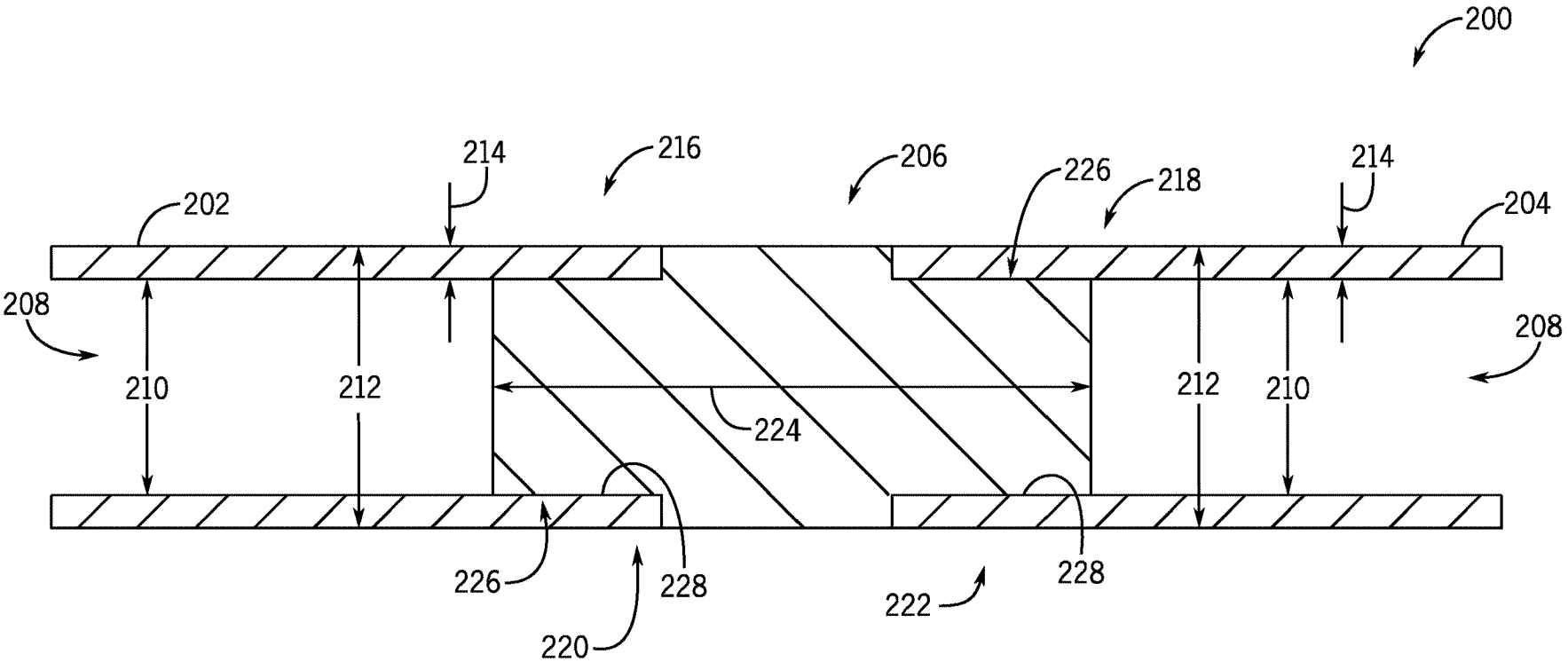
FIG. 2 (PRIOR ART)
FIG. 2 is a cross-sectional view of an embodiment of a prior art perforating string.

FIG. 2 is a schematic cross-sectional view of an embodiment of a prior art perforating string 200. In the illustrated embodiment, a pair of perforating guns 202, 204 is coupled together via a tandem 206. The illustrated perforating guns 202, 204 may be formed from expendable hollow carriers (EHC). The EHC forming the perforating guns 202, 204 may be manufactured via a hot finished extruded or cold down product, for example as a tubular product. However, using such fabrication processes provide the EHCs with insufficient wall thickness to from external threads. As a result, the perforating guns 202, 204 are not directly coupled together, but rather, the illustrated tandem 206 is utilized to engage internal threads of the EHCs.

In the illustrated embodiment, the perforating guns 202, 204 each include an opening 208, which may carry one or more components of the perforating guns 202, 204. The opening 208 has an internal diameter 210 that is less than an external diameter 212 of the EHC. In various embodiments, a wall thickness 214 (e.g., the different between the internal diameter 210 and the external diameter 212) is selected at least in part based on the anticipated pressure conditions for the perforating guns 202, 204. Accordingly, there may be a minimum wall thickness for withstanding certain external pressures at certain temperatures. Moreover, the wall thickness 214 may be particularly selected such that the shaped charges effectively perforate the casing. Due to the formation process of the EHC, the wall thickness 214 may be insufficient to provide external threads to couple the perforating guns 202, 204 directly together. As a result, the perforating guns 202, 204 are formed with respective box ends 216, 218. These box ends may have the same wall thickness 214 as other portions of the EHC. However, in various embodiments, the wall thickness 214 may be different. Thereafter, to couple the perforating guns 202, 204 together, the tandem sub 206 having respective pin ends 220, 222 is positioned to couple to the box ends 216, 218. In various embodiments, the tandem sub 206 further includes seals and the like to block fluid ingress into the perforating guns 202, 204.

The coupling arrangement illustrated in FIG. 2 adds weight to the perforating system 110 and also adds length, due to the added tandem sub length 224. This added length may be burdensome, especially with perforating strings having larger numbers of guns coupled together. Moreover, various leak paths 226 are introduced into the system due to the threaded connections 228. For example, the threaded connections 228 provide the pressure and fluid barriers between the wellbore annulus, which may be filled with various fluids (e.g., liquids, solids, gasses, or combinations thereof). Fluid ingress may damage internal components, thereby potentially interrupting perforating operations. Moreover, additional components may be more costly, thereby reducing the likelihood operators select such perforating operations. As will be described herein, embodiments of the present disclosure overcome the problems and deficiencies of the prior art systems.

Figure 3:
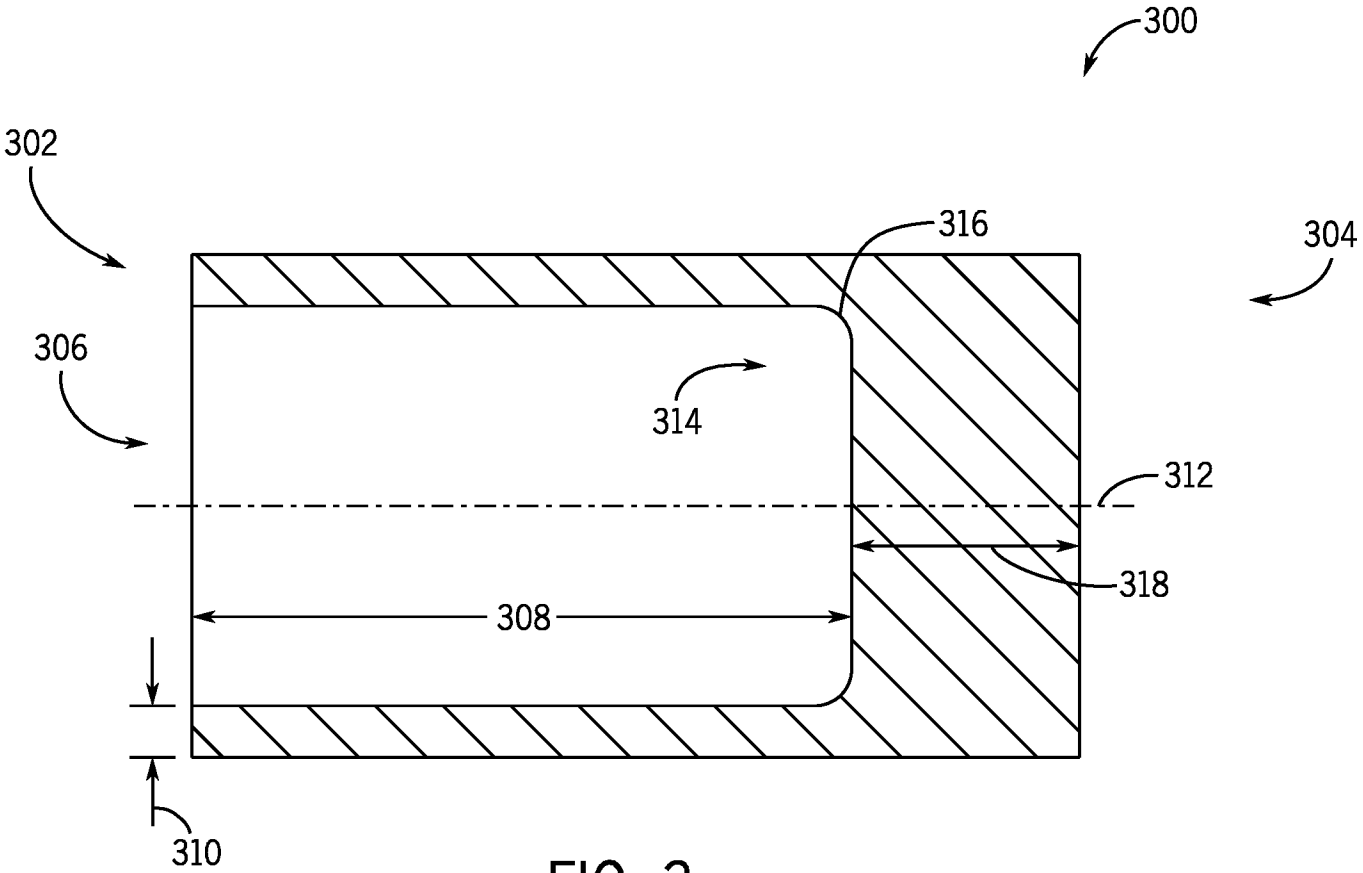
FIG. 3 is a cross-sectional view of an embodiment of an expendable hollow carrier, in accordance with embodiments of the present disclosure.

FIG. 3 is a cross-sectional side view of an expendable hollow carrier (EHC) 300, which may be utilized to form at least a portion of a perforating gun utilized in a perforating system, for example as part of a perforating string. As will be described below, in various embodiments the materials utilized to from the EHC 300 may be drawn out to enable formation of the EHC 300 with a solid end. The solid end may be machined as a pin end, thereby enabling coupling directly to a box end of another EHC forming a perforating gun. As a result, the above-described pin×pin tandem sub may be eliminated, thereby reducing tool string cost, reducing tool string length, improving reliability by reducing possible fluid leak paths, and reducing the weight of the tool string, among other advantages.

In various embodiments, the EHC 300 includes a first end 302 and a second end 304. The first end 302 may be referred to as an open end that includes an opening 306 for receiving various components of the perforating gun. The first end 302 has a length 308 and a wall thickness 310. As described above, the wall thickness 310 may be particularly selected to for wellbore pressures and temperatures and/or perforating pressures. While not included in the illustrated embodiment, in various embodiments the opening 306 may further include threads to facilitate connection to other EHCs 300.

The illustrated first end 302 is substantially centered about an axis 312 and may be formed in a tubular shape. An interior area 314 of the first end 302 includes a curved edge 316 where the first end 302 is attached to the second end 304. In various embodiments, the attachment may be an integral attachment (e.g., non-rotatably coupled). In other words, the first end 302 and the second end 304 may be formed from the same material and, as a result, the attachment may be a direct, integral coupling between the components that is not formed by an external or additional mechanism, such as by threads, bolts, clamps, and the like. The curved edge 316 may have a variety of radii, which may be particularly selected based on various components of the wellbore, the gun, and the like.

The second end 304 is formed as a solid block with a length 318. As will be described below, in various embodiments the second end 304 may be machined to form a pin end connection to couple to a box end connection of a second EHC, thereby enabling direct coupling between guns without utilizing the tandem sub. In various embodiments, the illustrated EHC may be formed by a combination of manufacturing methods or by a single manufacturing method. For example, a billet or bar stock may be utilized to form the EHC 300. In various embodiments, material, such as a flat plate, may be pressed in a deep drawing process. Moreover, in embodiments, processes such as flow forming may be utilized to fabricate at least a portion of the EHC 300. Additionally, various machining methods may be used to fabricate threaded components on the first end 302, the second end 304, or both. It should be appreciated that various dimensions associated with the EHC 300 may be particularly selected based on wellbore operations. For example, an external diameter, internal diameter, the wall thickness 310, the length 308, the length 318, and the like may be a variety of different dimensions corresponding to certain use cases.

Figure 4:
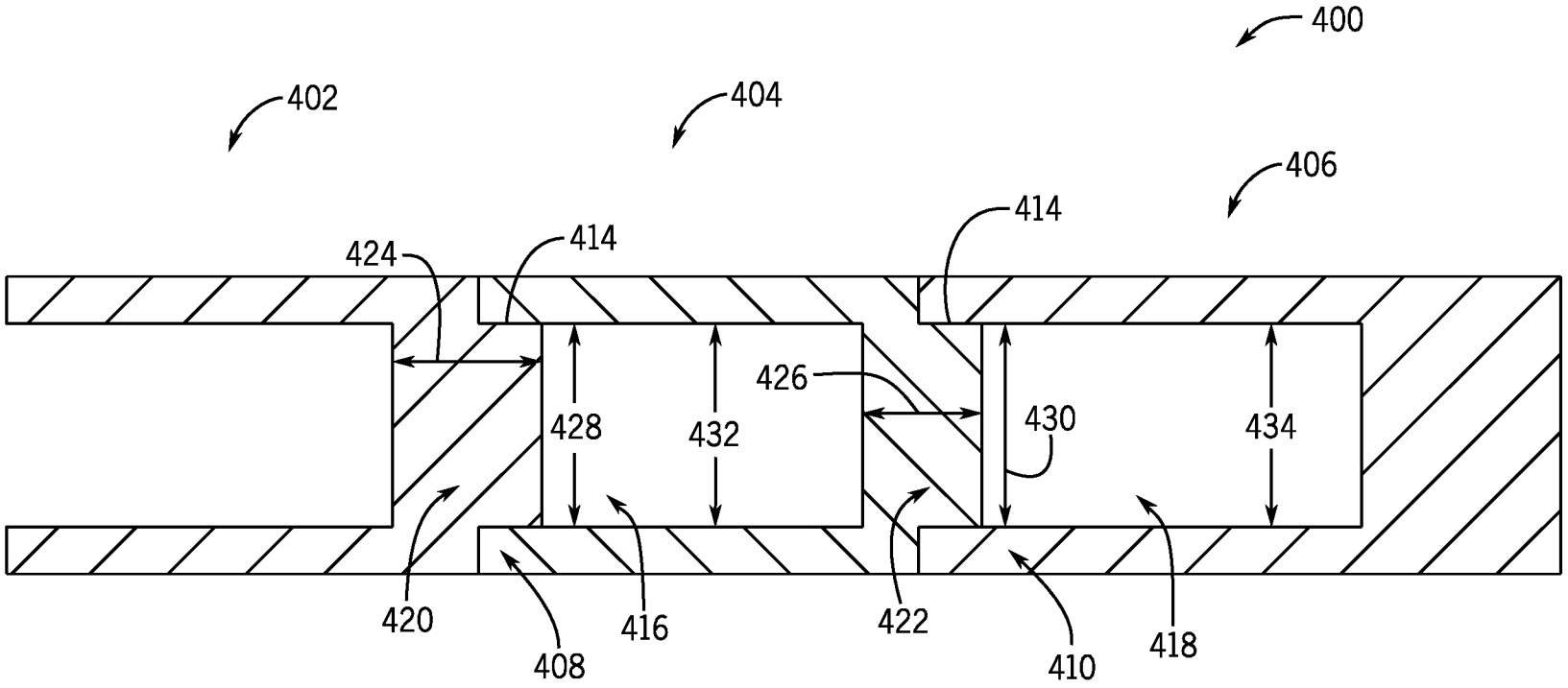
FIG. 4 is a cross-sectional view of an embodiment of a perforating string formed from the expendable hollow carrier of FIG. 3, in accordance with embodiments of the present disclosure.

FIG. 4 is a schematic cross-sectional view of an embodiment of a perforating string 400 illustrating guns 402, 404, 406 directly coupled together without the use of a tandem sub. As described above, in various embodiments the EHCs forming the guns 402, 404, 406 may be formed such that respective second ends 408, 410 including a coupling mechanism 414, such as threads, to directly couple to the respective first ends 416, 418 of the guns 404, 406. As a result, coupling three guns together forms two interfaces 420, 422, as opposed to four interfaces when using the tandem subs, which reduces potential leak points. Furthermore, the overall length of the perforating string 400 is reduced without the additional material of the tandem subs because at least a portion of the lengths of the guns 402, 404 extend into the openings of the guns 404, 406. This reduction in material also reduces the weight of the perforating string 400. As a result, overall costs associated with the perforating string 400 may be reduced.

In the embodiment illustrated in FIG. 4, at least a portion of respective lengths 424, 426 extending into the respective first ends 416, 418. It should be appreciated that the length of the portions may be particularly selected based on a variety of factors, such as pressures or temperatures of the wellbore, materials selected for fabrication of the EHC, and the like. As illustrated, the second ends 408, 410 are machined such that at least a portion of outer diameters 428, 430 correspond to inner diameters 432, 434 of the guns 404, 406. As described above, in various embodiments, the coupling mechanism 414 may be threaded components to facilitate quick connections between the guns 402, 404, 406. Furthermore in embodiments, various additional features may be included, but have been removed for clarity, such as various seals, shoulders, tortuous flow paths, and the like.

Figure 5A:
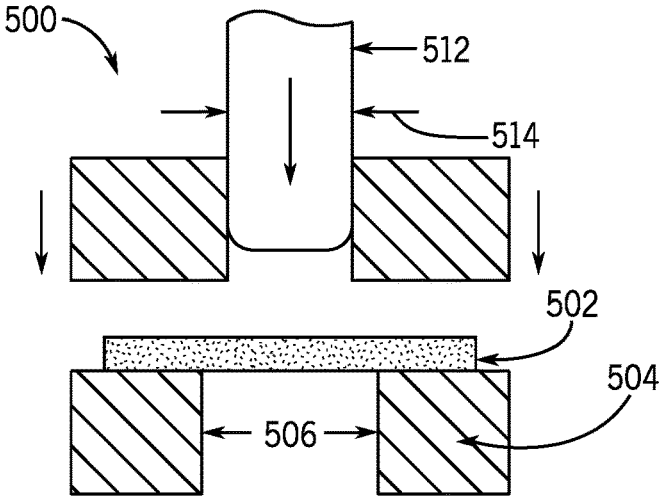
FIGS. 5A-5C are schematic diagrams of embodiments of forming processes, in accordance with embodiment of the present disclosure.
Figure 5B:
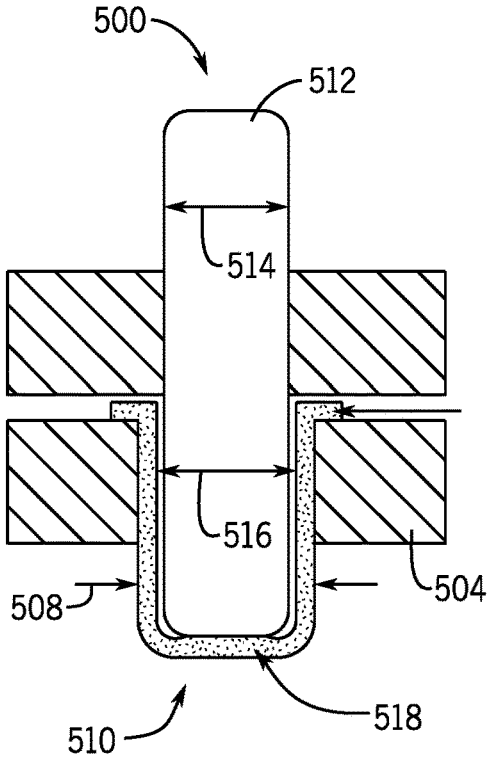
Figure 5C:
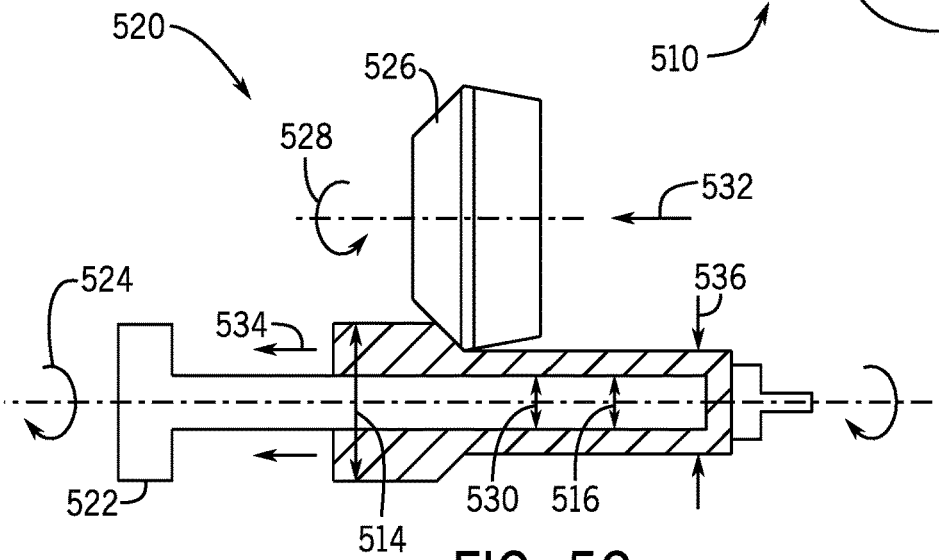

FIGS. 5A-5C are schematic cross-sectional diagrams of forming processes 500, 520 which may be utilized to form the EHCs described above. In various embodiments, one of the processes 500, 520 may be used in the forming process. However, in other embodiments, both of the processes 500, 520 may be used. For example, the forming process 500, which may be referred to as a drawing or deep drawing process, and may first form at least a portion of the EHC. Thereafter, the process 520, which may be referred to as a flow forming process, may be utilized to form the remainder of the EHC. Accordingly, while each process may be described independently, it should be appreciated that one or both may be utilized to fabricate the EHC.

In the embodiment illustrated in FIGS. 5A and 5B, which as described above may be called a deep drawing process 500, a blank 502 (e.g., a billet) may be aligned with a die 504. The die 504 may include a diameter 506, which will define an outer diameter 508 of the EHC 510. In operation, a punch 512 is driven, for example by a hydraulic press, into the blank 502 to thereby form the EHC 510. The illustrated punch 512 has an outer diameter 514, which may correspond to an inner diameter 516 of the EHC 510. Furthermore, various dimensions may be adjusted based on particularly selected dimensions, such as the length 308, the length 318, and the like, as illustrated in FIG. 3. In this manner, the EHC 510 may be formed with a second end 518 that may be machined to enable direct coupling to a box end of a mating EHC.

In various embodiments, the flow forming process 520 illustrated in FIG. 5C may be used in place of, or in addition to, the deep drawing process 500. For example, in various embodiments, it may be desirable to form the EHC 510 via the deep drawing process 500 at a predetermined size and then, through further machining processes, adjust the respective outer diameter 514. For example, in various embodiments, it may be desirable to initially form the EHC 510 having a larger outer diameter 514 than desirable using the deep drawing process 500 and then to use to the flow forming process 520 to adjust an overall length of the EHC 510, as well as the outer diameter 514. In the embodiment illustrated in FIG. 5C, the EHC 510 is arranged on a mandrel 522, which is driven to rotate in a first direction 524. One or more rollers 526 rotate in an opposite second direction 528 and are brought radially inward toward the outer diameter 514 of the EHC 510. As illustrated in FIG. 5C, a mandrel diameter 530 may be substantially equal to the inner diameter 516, and as a result, the process 520 may be used to adjust the outer diameter 514 of the EHC 510.

In various embodiments, as the mandrel 522 rotates the EHC 510, the one or more rollers 526 are driven in a feed direction 532. This movement of the one or more rollers 526 drives material of the EHC 510 in a flow direction 534, which is substantially the same as the feed direction 532 in the illustrated embodiment. As a result, the outer diameter 514 is reduced to a second outer diameter 536, which is substantially equal to a radial position of the one or more rollers 526, and also an overall length of the EHC 510 may be increased as the material flows in the flow direction 534. In this manner, various dimensions of the EHC 510 may be adjusted as particularly selected for various embodiments.

Figure 6:
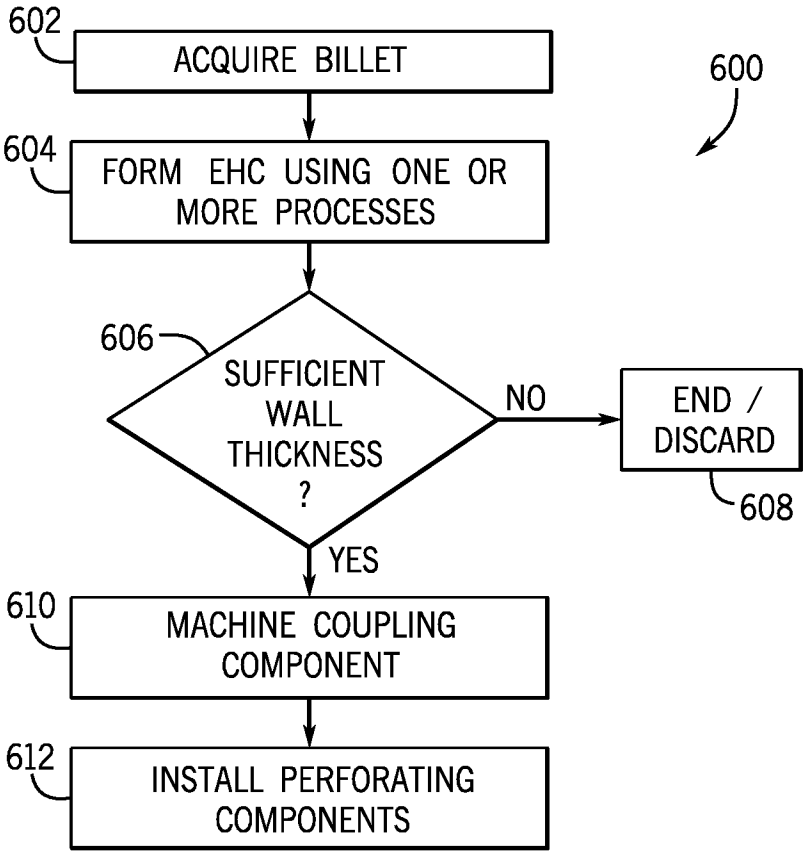
FIG. 6 is a flow chart of an embodiment of a method of forming a perforating gun, in accordance with embodiments of the present disclosure.

FIG. 6 is a flow chart of an embodiment of method 600 for forming and perforating gun. It should be appreciated that the steps described in the method may be performed in parallel or in a different order, unless otherwise explicitly stated. Furthermore, in various embodiments, there may be more or fewer steps. Additionally, in certain embodiments, one or more steps may be omitted. In this example, a billet is acquired for use in a machine process (block 602). For example, the billet may be a plate formed from a metallic material, such as a steel, a steel alloy, a composite material, or the like. The billet may be used to form the EHC using one or more manufacturing processes (block 604). For example, the deep drawing process described with respect to FIGS. 5A and 5B may be utilized to from the EHC. Additionally, in various embodiments, the flow forming process described with respect to FIG. 5C may be utilized. It should be appreciated that the EHC described herein includes at least the second end 304 that enables the coupling mechanism 414 to be installed along the body to enable a direct coupling between adjacent EHCs on the perforating string. The wall thickness may be evaluated (operator 606) to determine whether there is sufficient material to enable machining of the coupling component. If not, the material may be discarded or reworked (block 608). If there is sufficient material thickness, the coupling component may be machined onto the EHC (block 610). The perforating components, such as the shaped charge, detonator, and the like may then be installed within the EHC (block 612). In this manner, the EHC may be formed to enable downhole perforating operations.

Figure 7:
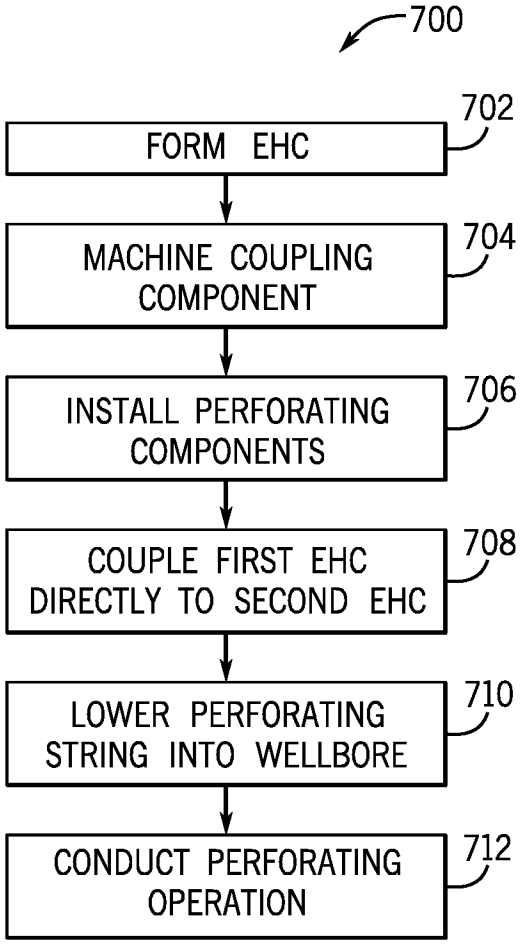
FIG. 7 is a flow chart of an embodiment of performing a perforating operation, in accordance with embodiments of the present disclosure.

FIG. 7 is a flow chart of a method 700 for performing perforating operations using the EHC. In this example, the EHC is formed (block 702). In various embodiments, the EHC is formed using one or more manufacturing processes described herein. The coupling component may be machined onto the EHC (block 704). For example, the coupling component may include threads that are machined onto the second end 304 to facilitate coupling between adjacent EHCs. That is, the machining may enable the second end 304 to become the pin end of a connection that mates with a box end of an adjacent EHC. The perforating components may be installed within the EHC (block 706). Next, a first EHC may be coupled directly to a second EHC (block 708). For example, as illustrated in FIG. 4, the first EHC may correspond to the gun 402 and the second EHC may correspond to the gun 404. The pin end of the gun 402 may be coupled to the box end of the gun 404 via the coupling mechanism 414, thereby forming a direct coupling between adjacent guns 402, 404 without the use of a tandem sub or other intermediate coupling component. In various embodiments, the perforating string may be lowered into the wellbore (block 710). Thereafter, perforating operations may be performed within the wellbore (block 712). Accordingly, perforating operations are enabled utilizing perforating guns that are directly coupled together without the use of an intermediate sub or coupling device, thereby reducing string length, weight, and costs.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

The invention claimed is:

1. A method for fabricating a perforating gun, comprising:
forming an expendable hollow carrier (EHC) via a drawing process;
determining a wall thickness of the EHC is above a threshold;
machining a coupling component to at least one end of the EHC; and
installing perforating components within an interior of the EHC.

2. The method of claim 1, wherein forming the EHC further comprises:
forming a first end of the EHC, the first end having an opening; and
forming a second end of the EHC, the second end being a solid component that is non-rotatably coupled to the first end.

3. The method of claim 2, wherein the coupling component is machined on an outer diameter of the second end.

4. The method of claim 3, wherein an outer diameter of the first end is equal to the outer diameter of the second end before the coupling component is machined onto the second end.

5. The method of claim 1, further comprising:
adjusting an outer diameter of the EHC via a flow forming process.

6. The method of claim 1, wherein the coupling component is machined into a second end of the EHC, the method further comprising:
forming a second EHC via the drawing process;
machining the coupling component into a first end of the second EHC; and
coupling the second end of the EHC directly to the first end of the second EHC.

7. The method of claim 6, wherein the coupling component on the first end of the second EHC is arranged on an interior diameter of the second EHC and the coupling component on the second end of the EHC is arranged on an outer diameter of the EHC.

8. The method of claim 1, further comprising:
forming at least a portion of the EHC using a flow forming process.

9. The method of claim 5, wherein adjusting the outer diameter increases a length of the EHC.

* * * * *